US006827430B2

(12) United States Patent
Tsujimoto et al.

(10) Patent No.: US 6,827,430 B2
(45) Date of Patent: Dec. 7, 2004

(54) LIQUID CONTAINER AND METHOD OF MANUFACTURING LIQUID CONTAINER

(75) Inventors: Akira Tsujimoto, Kanagawa (JP); Kiyomitsu Kudo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 21 days.

(21) Appl. No.: 10/369,571

(22) Filed: Feb. 21, 2003

(65) Prior Publication Data

US 2003/0160847 A1 Aug. 28, 2003

(30) Foreign Application Priority Data

Feb. 22, 2002 (JP) ..... 2002-046708

(51) Int. Cl.[7] ..... B41J 2/175
(52) U.S. Cl. ..... 347/85; 347/86
(58) Field of Search ..... 347/84, 85, 86, 347/87

(56) References Cited

U.S. PATENT DOCUMENTS 5,666,146 A * 9/1997 Mochizuki et al. ..... 347/86
6,053,606 A * 4/2000 Yamaguchi et al. ..... 347/86
6,120,140 A 9/2000 Hirosawa et al. ..... 347/93
6,247,806 B1 6/2001 Matsumoto et al. ..... 347/87
6,276,783 B1 8/2001 Ishinaga et al. ..... 347/65
6,331,043 B1 12/2001 Shimazu et al. ..... 347/48
6,505,915 B2 1/2003 Asakawa et al. ..... 347/65
2003/0160848 A1 8/2003 Taniguchi et al. ..... 347/86

FOREIGN PATENT DOCUMENTS

JP 02000296621 A * 10/2000 ..... B41J/2/175

* cited by examiner

*Primary Examiner*—Anh T. N. Vo
(74) *Attorney, Agent, or Firm*—Fitzpatrick, Cella, Harper & Scinto

(57) ABSTRACT

A liquid container and a method of manufacturing the same are provided which can prevent a possible loss of airtightness in the liquid container and a possible ink leakage to enhance reliability and at the same time can reduce a manufacturing cost and the number of processes. For this purpose, the liquid container for supplying a liquid to a liquid ejection part, including: a container body containing the liquid; and a cylindrical liquid supply member hermetically secured to an opening formed in a bottom portion of the container body; wherein the opening is thermally fused to the liquid supply member.

1 Claim, 6 Drawing Sheets

LIQUID CONTAINER AND METHOD OF MANUFACTURING LIQUID CONTAINER

This application claims priority from Japanese Patent Application No. 2002-046708 filed Feb. 22, 2002, which is incorporated hereinto by reference.

BACKGROUND OF THE INVENTION

1. Field of the Invention

The present invention relates to a liquid container for supplying a liquid (ink) to a liquid ejection means used in a variety of printing fields and also to a method of manufacturing the liquid container.

2. Description of the Related Art

Ink jet printing apparatus have an advantage over laser beam printers using a toner as a printing material in that they can easily be reduced in size and weight and constructed inexpensively. Because of this advantage, the ink jet printing apparatus is most suitable as a small output device. In digital cameras of recent years in particular, there are demands that images shot by the cameras be able to be printed out on the spot. To meet this demand ultrasmall ink jet printing apparatus small enough to be mounted on the camera body or carried by user have been proposed and implemented.

Some such ultrasmall ink jet printing apparatus are known to have a construction in which a head cartridge having a liquid ejection means for ejecting ink and a liquid container integrally connected to the liquid ejection means to supply ink to it is removably mounted on a carriage.

The liquid container in the head cartridge can accommodate only a small volume of ink, which is consumed in a short period of time, and thus requires to be supplied frequently with ink. To deal with this problem, an ink jet printing apparatus, which employs a so-called pit-in system has been proposed. In the system a main tank as a liquid source supplies ink to the liquid container.

In the ink jet printing apparatus using the pit-in system, an ink supply to the liquid container is performed as follows. The carriage is moved to a predetermined supply position, which may be at the end of a carriage path. At this position, the liquid container is connected to the main tank and the container is connected to the pomp, as required. Then a negative pressure is created in the liquid container by the pump to draw ink from the main tank into the liquid container by suction.

When ink is replenished in such a pit-in system, an exact predetermined amount of ink must be supplied to the liquid container. This requires that connection and disconnection between a connecting portion of the ink tank and an ink supply member of the liquid container be performed reliably. Further, since the ink supply to the liquid container is performed frequently, a connecting portion between the liquid container and the main tank, particularly the ink supply member, is required to have high durability and reliability.

Generally, the liquid container and the main tank are connected and disconnected by bringing the ink supply member protruding from the liquid container into and out of engagement with a connection member provided at one end of an ink supply tube coming out of the main tank. However, as the connection and disconnection between the ink supply member and the connection member are repeated frequently, the ink supply member may be damaged in a short period of time. That is, since the ink supply member on the liquid container side is bonded to a container body with an adhesive, the bonded portion is subject to bonding strength variations and degradation due to contact with ink, which is likely to result in a joint portion between the ink supply member and the container being damaged.

Once the joint portion of the ink supply member is damaged, the container cannot maintain its air tightness during the pit-in operation, failing to supply an appropriate amount of ink. Further, the ink in the container may leak out from the head cartridge through the damaged joint portion of the ink supply member, contaminating the interior of the apparatus. In some cases, ink may leak out into an entire ink supply system, leading to a fatal electric short-circuit trouble.

Further, the manufacturing method described above requires a quality management system for adhesives used and additional processes, such as adhesive application and hardening processes, increasing cost and number of processes.

SUMMARY OF THE INVENTION

The present invention has been accomplished to overcome the above drawbacks and provides a liquid container and a method of manufacturing liquid container which can prevent a possible loss of airtightness in the liquid container and a possible ink leakage to enhance reliability and at the same time can reduce a manufacturing cost and the number of processes.

The above objective is realized by the following aspects of the present invention.

In one aspect, the present invention provides a liquid container for supplying liquid to a liquid ejection means, comprising: a container body containing the liquid; and a cylindrical liquid supply member hermetically secured to an opening formed in a bottom portion of the container body; wherein the opening is thermally fused to the liquid supply member.

The liquid supply member may have a cylindrical portion having a press fit portion to be fitted under pressure into the opening.

Further, the liquid supply member may have: a cylindrical portion having a press fit portion to be fitted under pressure into the opening; and a flange portion protruding outwardly from an outer surface of the cylindrical portion and adapted to engage the bottom portion of the container body when the press fit portion is fitted under pressure into the opening.

Further, the liquid supply member is preferably formed of a heat resisting member.

In another aspect, the present invention provides a method of manufacturing a liquid container for supplying a liquid to liquid ejection means, the method comprising: a press fit step of fitting a cylindrical liquid supply member under pressure into an opening formed in a bottom portion of a container body containing the liquid; and a heating step of heating by predetermined heating means the opening in which the liquid supply member is fitted under pressure by the press fit step; wherein the opening is heated and melted by the heating step to hermetically secure the opening and the liquid supply member together by thermal fusing.

Further, the heating means may be indirect heating means for applying heat to a portion surrounding the opening through the liquid supply member.

Further, the heating means may comprise a light beam generator for radiating a beam of light of a predetermined wavelength to the liquid supply member.

Further, the heating means may be direct heating means for directly applying heat to a portion surrounding the opening.

In the liquid container and head cartridge of this invention constructed as described above, since the container body is melted and directly joined to the ink supply member, the strength of joint between the ink supply member and the container tank and the container airtightness can be improved significantly, compared with the conventional construction in which the container body and the ink supply member are joined by means of an adhesive. This prevents damage to the joint between the ink supply member and the container body even if the connection portion of the main tank is connected to and disconnected from the ink supply member frequently. Thus, an appropriate joint state can be maintained for a long period of time. This in turn enables ink to be supplied properly into the liquid container and eliminates a possibility of ink leaking through the joint between the opening and the liquid supply member. Therefore, it is possible to reliably prevent a contamination of the interior of the printing apparatus with a leaking ink and also an electric system becoming short-circuited.

Further, a quality management system for adhesives and adhesive application and hardening processes are not required, as they are when adhesives are used. This reduces cost and the number of processes.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, embodiments of the present invention will be described in the following.

First Embodiment

Figure 1:
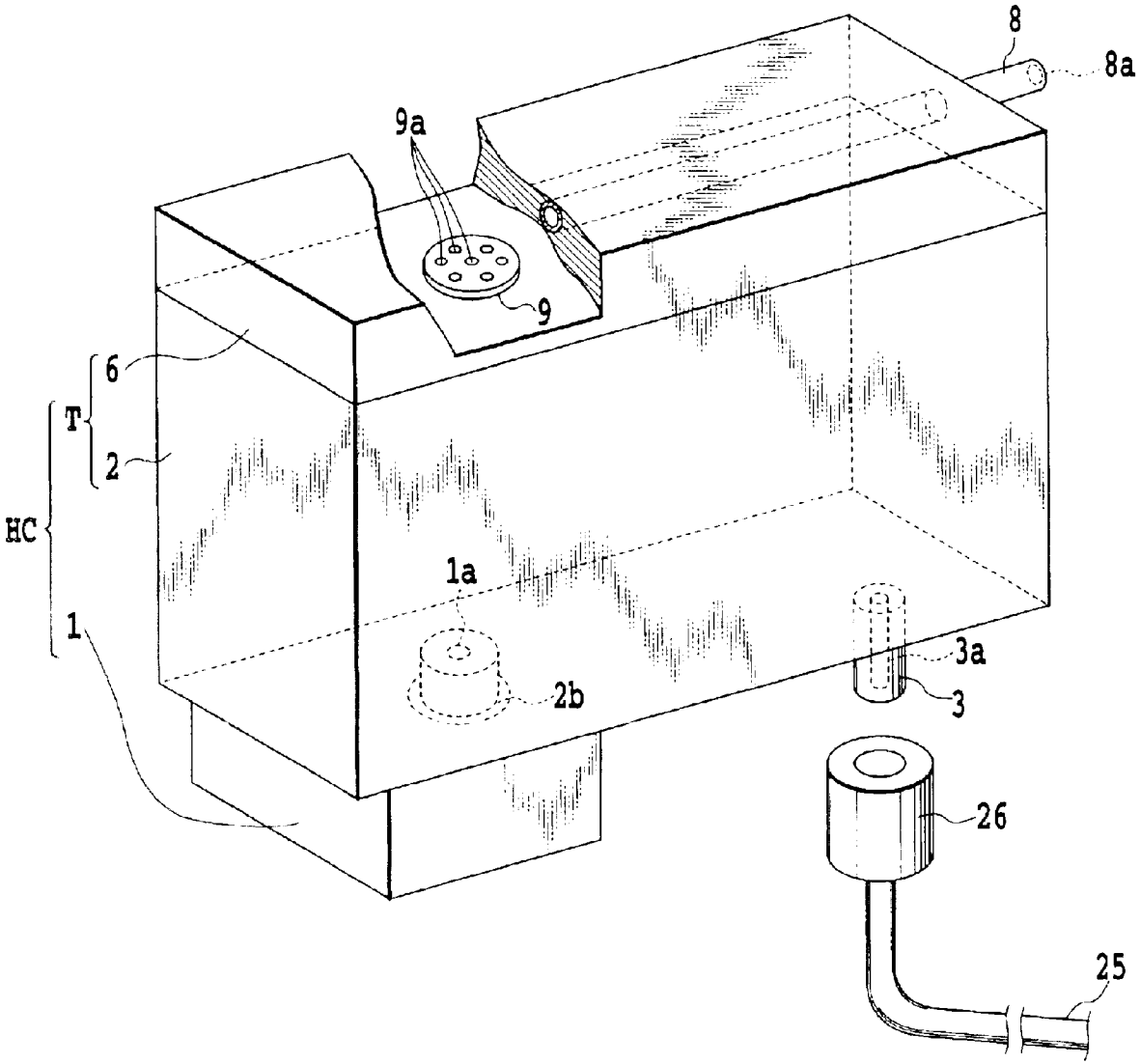
FIG. 1 is a partly cutaway perspective view showing a first embodiment a liquid container according to the present invention.

FIG. 1 is a partly cutaway perspective view showing a construction of the liquid container according to the first embodiment of this invention.

In FIG. 1, a liquid ejection unit (liquid ejection means) 1 has a plurality of arrayed, known print elements for ejecting a liquid. In this first embodiment, the liquid supplied from a common liquid path formed in the ejection unit 1 to the print elements is ejected by activating electrothermal transducers installed one in each print element. That is, each of the print elements generates Joule heat by energizing the associated electrothermal transducer to cause a film boiling in the ink and thereby produce a bubble in the ink in each print element path, which in turn ejects an ink droplet from the ejection opening of the print element as it grows. This is a so-called bubble jet (trademark) ejection system. The liquid ejected from the ejection unit 1 includes a liquid (coloring material) to be visually recognized on a print medium and a liquid (print performance improving liquid) to adjust a penetrating characteristic of the coloring material. In the description that follows, these liquids are also generally called an ink.

T denotes a liquid container that supplies an ink to a common liquid chamber communicating with individual print elements and is constructed as follows.

In this liquid container T, designated 2 is a container body shaped like a hollow box (hollow cuboid). The container body 2 has its bottom portion formed with an ink supply portion (liquid supply portion) for supplying ink from an ink source into the container body 2 and also with a connection hole 2*b* into which a cylindrical connection portion 1*a* protruding from an upper surface of the ejection unit 1 is fitted watertight. The container body 2 also has its upper surface formed with an atmosphere communication port 2*c*. The connection portion 1*a* of the ejection unit 1 communicates with the common liquid chamber. When the connection portion 1*a* is fitted tightly into the connection hole 2*b* of the container body 2, an ink storage space in the container body 2 communicates with the common liquid chamber in the ejection unit 1.

The ink supply portion is constructed of a tubelike ink supply member (liquid supply member) 3 fitted and fixed in an opening 2*a* formed in the bottom portion of the container body 2. One end of the ink supply member 3 (press fit portion) communicates with an interior of the container body 2 and the other end protrudes outside the container body 2. A portion 3*b* of the ink supply member 3 that protrudes outwardly from the container body 2 is removably fitted into a connection member 26 securely attached to one end of an ink supply tube 25 extending from the main tank not shown, which functions as an ink source. When the connection member 26 is fitted over the outwardly projecting portion 3*b*, they are maintained in a watertight connection state.

Designated 6 is a cover secured to the upper surface of the liquid container T. The cover 6 is hollow and has an atmosphere communication space 7 formed therein. The cover 6 also has an opening 7*a* formed in its bottom portion which communicates with the atmosphere communication space 7 and an atmosphere communication tube 8 inserted and fixed in its side which communicates with the atmosphere communication space 7. The atmosphere communication tube 8 has an air suction port 8*a* at one end that opens into the atmosphere. The cover 6 is provided with a fixed porous member 9 covering the opening 7*a*. The porous member 9, when the cover 6 is secured to the container body 2, covers the atmosphere communication port 2*c* watertightly. The porous member 9 is applied with a water repellent (not shown) on the atmosphere communication space 7 side so that it functions as a gas-liquid separation valve which passes a gas but not liquid (ink).

The atmosphere communication space 7 and the atmosphere communication tube 8 combine to form an atmosphere communication passage extending from the air suction port 8*a* to the atmosphere communication port 2*c*. The cover 6 and the container body 2 together form the liquid container T. The liquid container T and the ejection unit 1 combine to form a head cartridge HC which is removably mounted on the carriage of the ink jet printing apparatus.

The porous member 9 may use a variety of constructions. For example, it may be constructed of a multifiber body which is made by laminating resin fiber and metal fiber layers and sintering them. In that case, an estimated amount of gas that is considered to pass through the porous member 9 is converted into a theoretical hole diameter, and then a fiber diameter and an after-the-sintering density that will provide the theoretical hole diameter in the porous member 9 are determined.

Figure 2:
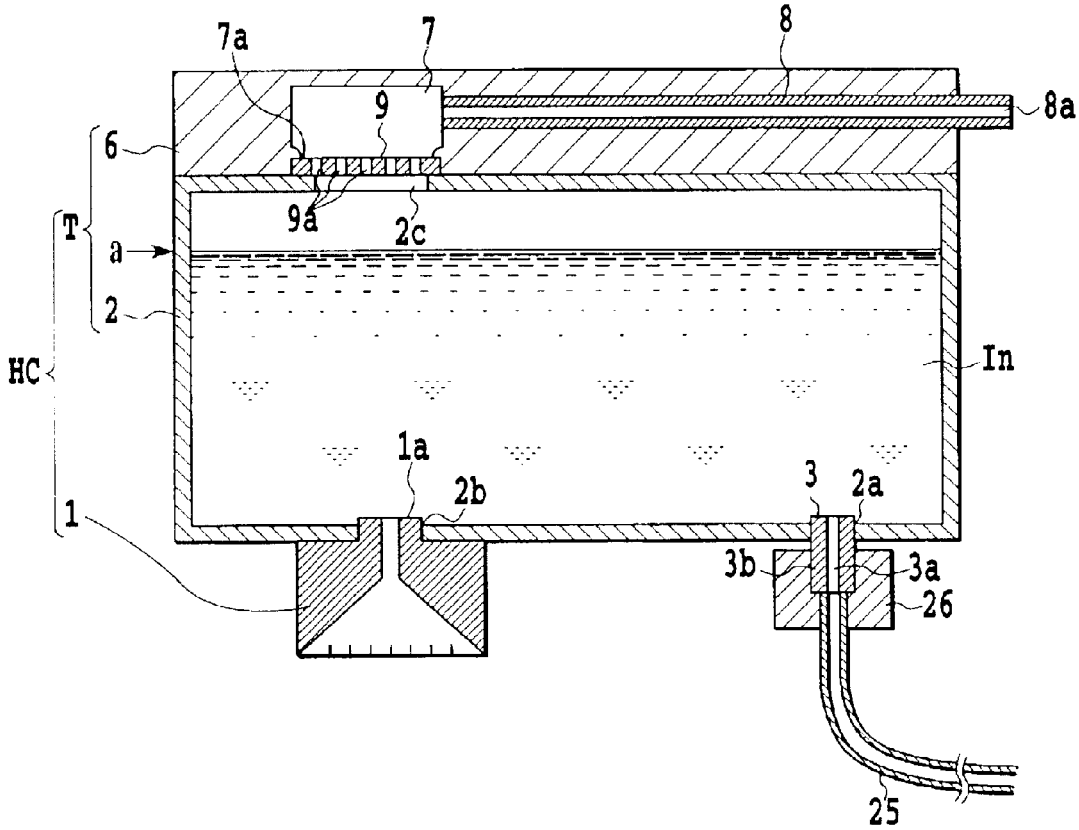
FIG. 2 is a vertical side cross-sectional view showing the liquid container of FIG. 1 being supplied with ink.

FIG. 2 is a vertical side cross-sectional view showing the liquid container T being filled with an ink In. In the figure, level a represents a liquid level corresponding to an ink volume required to perform a predetermined continuous printing operation.

When the ink In is supplied into the container body 2, the carriage is moved to a predetermined ink supply position where the ink supply member 3 faces the connection member 26. This is followed by vertically moving the carriage and the connection member 26 relative to each other to engage the ink supply member 3 with the connection member 26. At this time the ink supply member 3 and the connection member 26 engage watertightly.

Then, a pump or the like connected to the atmosphere communication tube 8 is activated to generate a negative pressure in the container body 2. This negative pressure draws the ink In from the main tank (not shown) as an ink source through the ink supply tube 25 and the connection member 26 into the container body 2.

This ink supply continues until the rising ink level exceeds the level a corresponding to the ink volume required to perform a predetermined continuous printing operation and reaches the upper surface of the container body 2, i.e., the underside of the porous member 9 bonded to the cover 6 (the container body 2 is now full), at the time the ink suction operation by the pump is stopped by the action of the water repellent applied to the porous member 9 and of meniscuses at holes 9*a* of the porous member 9. This can be done by adjusting the suction pressure of the pump.

Then, when the ink ejection from the ejection unit 1 for printing is started, the ink in the container body 2 is progressively consumed, lowering the liquid level of ink gradually.

When the level of ink In decreases to a predetermined level, the connection member 26 and the ink supply member 3 are connected again at an appropriate timing and the pump is activated to draw out air from the air suction port 8*a* to produce a negative pressure in the container body 2 to draw ink from the main tank through the ink supply tube 25 and the ink supply member 3 into the container body 2.

In the liquid container T of this embodiment, it is necessary to use a material that will not be dissolved by the contact with the ink In. It is therefore desired that the container body 2 and the cover 6 be formed of resins that has corrosion resistance and moldability, such as polysulfone, polyethylene, polypropylene, HIPS and PES. This embodiment uses polysulfone.

Since the connection member 26 and the ink supply member 3 are connected and disconnected each time the ink supply operation is performed, metals such as stainless steel and ceramics should preferably be used considering the corrosion resistance to ink and the connection strength. In this embodiment, stainless steel (SUS303) is used.

Now, the method of manufacturing the ink supply member 3 and the container body 2 in this embodiment will be described.

Figure 3A:
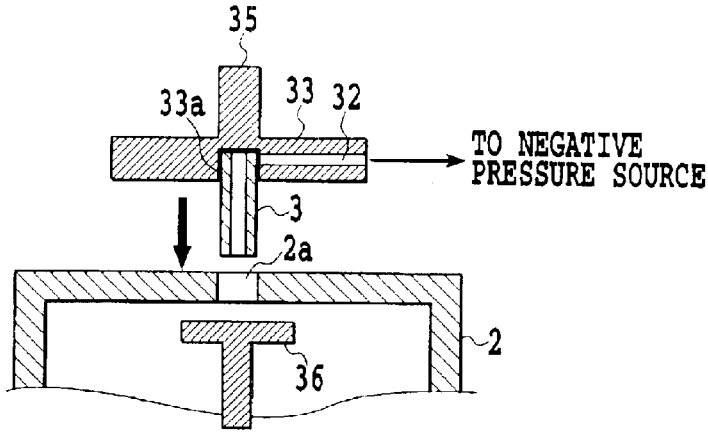
FIG. 3A is an explanatory, vertical side cross-sectional view showing a process of attaching an ink supply member to a container body of the liquid container of FIG. 1, with the ink supply member held by a holder.
Figure 3B:
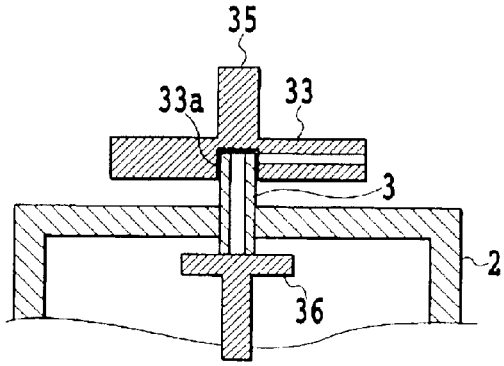
FIG. 3B is an explanatory, vertical side cross-sectional view showing a process of attaching the ink supply member to the container body of the liquid container of FIG. 1, with the ink supply member fitted under pressure into an opening formed in a bottom portion of the container body.
Figure 3C:
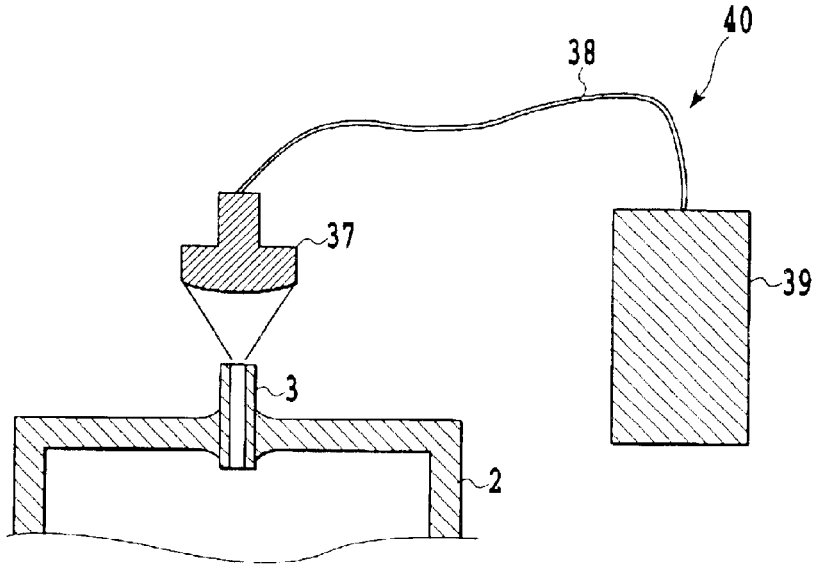
FIG. 3C is an explanatory, vertical side cross-sectional view showing a process of attaching the ink supply member to the container body of the liquid container of FIG. 1, with a portion of the container body surrounding the opening being indirectly heated in the state of FIG. 3B.

FIGS. 3A, 3B and 3C are vertical side cross-sectional views showing a series of steps of joining the ink supply member 3 and the container body 2. In FIGS. 3A, 3B and 3C, the underside of the bottom portion of the container body 2 is shown facing up in the drawing, and FIG. 3A shows the ink supply member 3 held over the underside of the bottom portion.

FIG. 3A illustrates the ink supply member 3 and the container body 2 of the liquid container T before the ink supply member 3 is assembled to the container body 2.

As shown, the bottom portion of the liquid container T is formed with the opening 2*a* into which the ink supply member 3 is to be inserted. In this embodiment, the opening 2*a* is formed slightly smaller than the ink supply member 3 so that the ink supply member 3 can be fitted under pressure into the opening 2*a*.

The ink supply member 3 is held by a holder 33, which is formed with a holding recess 33*a* for receiving and holding a part of the ink supply member 3 and with an air suction hole 32 communicating with the holding recess 33*a*. The air suction hole 32 is connected to a negative pressure source such as pump. The ink supply member 3 inserted in the holding recess 33*a* of the holder 33 is held there by a suction force created by the pump connected to the air suction hole 32.

Further, above the ink supply member 3 is provided a press jig 35 for pressing the ink supply member 3 under pressure into the opening 2*a* of the container body 2. Beneath the bottom portion of the container body 2 at a position facing the opening 2*a* of the bottom portion, a stopper 36 is disposed.

FIG. 3B shows a process of press fitting the ink supply member 3, which is in the state of FIG. 3A, into the bottom portion of the container body 2 of the liquid container T.

In this process, the ink supply member 3 in the state of FIG. 3A is pushed down by the press jig 35 and fitted under pressure into the opening 2*a* of the container body 2. The distance that the ink supply member 3 is advanced into the opening 2*a* is predetermined by the position of the stopper 36 disposed below the opening 2*a*. That is, the ink supply member 3 is pushed down until it engages the upper surface of the stopper 36. With the ink supply member 3 fitted into the opening 2*a*, the holder 33 is retracted from the ink supply member 3.

FIG. 3C shows a process of fusing the ink supply member 3, which is in an assembled state of FIG. 3B, to the opening 2*a* by heat.

In this heating process, a light beam emitted from a light beam generator 40 is radiated toward the ink supply member 3 to indirectly heat a portion surrounding the opening 2*a* through the ink supply member 3. The light beam generator 40 comprises an oscillation source 39 to generate a particular wave of light, a fiber 38 to conduct the light generated by the oscillation source 39, and a fiber lens 37 to focus the light from the fiber 38 into the ink supply member 3 as a beam. Other indirect heating methods applicable to this embodiment include, for example, an electromagnetic induction heating, a soft beam heating, a semiconductor laser heating and an ultraviolet radiation heating.

Here, an LD soft beam device (YB-15FL1) of Matsushita Electric Industries make with a fiber diameter of 0.9 mm was used to radiate a beam with an output of 4 w for two seconds. Optimum means and conditions for indirect heating can be chosen from the material and shape of the ink supply member 3 to be heated.

When a beam of a particular wavelength is applied to the ink supply member 3 under the above condition, the ink supply member 3 absorbs light and self-heats fusing the resin of the container body 2 near the opening 2*a* in which the ink supply member 3 is fitted. After the heating is finished, the melted resin near the opening 2*a* gradually hardens, causing the opening 2*a* to intimately adhere and fix to the ink supply member 3. In this embodiment, the polysulfone resin is used for the container body 2 and this resin starts to melt at around 220° C. and hardens below 180° C. The melting condition can be adjusted according to the output condition and heating time of the indirect heating device.

Further, if the heating temperature produced by the indirect heating device alone is not sufficient, other heating source such as a heating iron may be used as auxiliary means and held in indirect contact with the ink supply member 3 or container body 2.

Next, dimensions of various parts associated with the jointing of the ink supply member 3 and the container body 2 of this embodiment will be explained.

Figure 4:
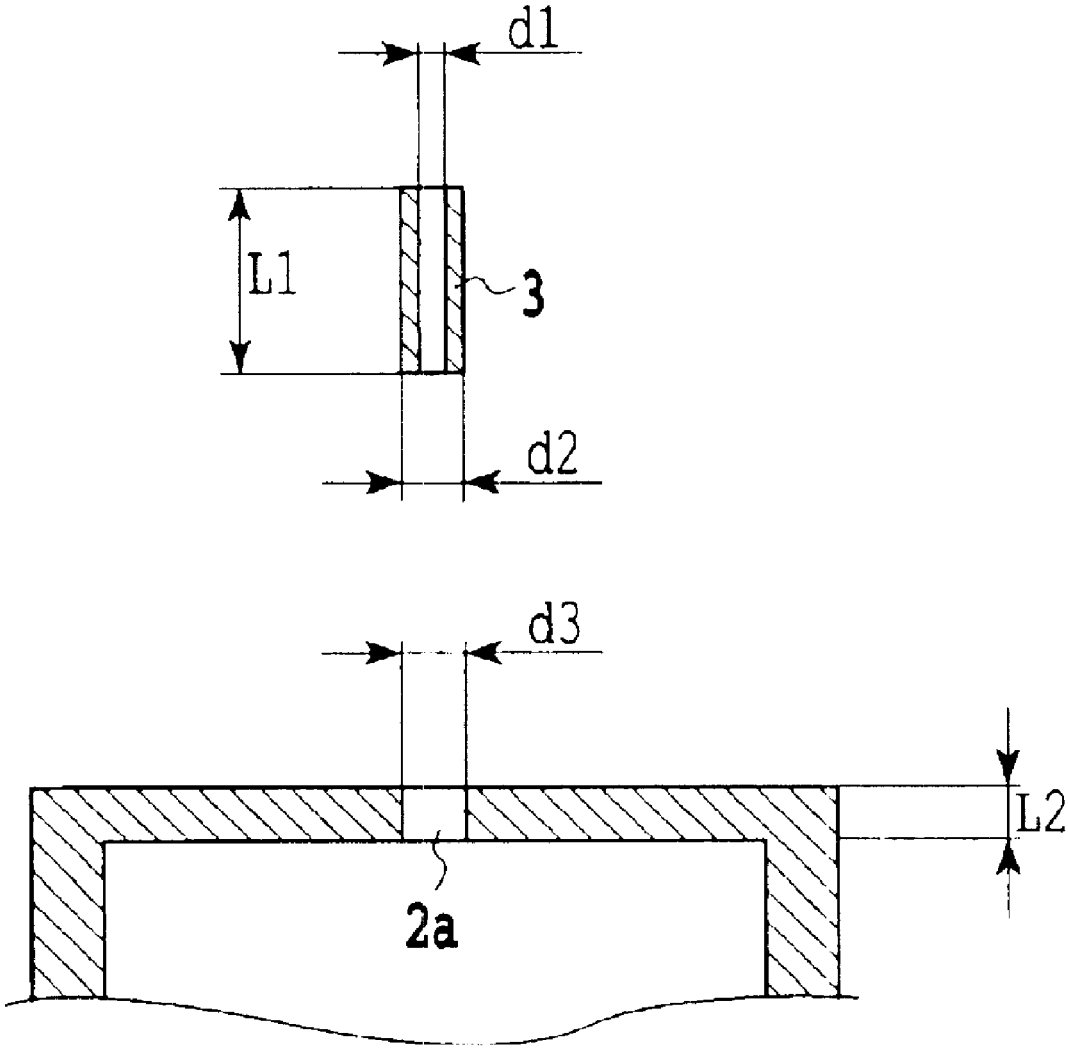
FIG. 4 is a vertical side cross-sectional view showing dimensions and shapes of the opening formed in the bottom portion of the liquid container and the ink supply member.

FIG. 4 is a vertical side cross-sectional view showing the shapes and dimensions of the ink supply member 3 and the opening 2*a* of the container body 2.

As shown in FIG. 4, the ink supply member 3 is shaped like a tube with the following dimensions:

inner diameter d1: 0.2 mm with a tolerance of ±0.05 mm
outer diameter d2: 0.46 mm with a tolerance of ±0.02 mm
total length L1: 3.2 mm with a tolerance of ±0.05 mm.

The opening 2*a* of the container body 2 has the following dimensions:

opening diameter d3: 0.35 mm with a tolerance of +0.02 mm to −0.01 mm
opening depth L2: 1 mm with a tolerance of ±0.05 mm.

When the above dimensions were used and the ink supply member 3 was joined to the opening 2*a* of the container body 2 over a joint length (press fit distance) of 1 mm ±0.1 mm, the joint was found to have a strength of 600 gf or higher.

Then the ink supply member 3 was heated for two seconds with a 4-w output beam generated by the LD soft beam device (YB-15FL1) of Matsushita Electric Industries make with a fiber diameter of 0.9 mm. This heating resulted in a joint between the opening 2*a* and the ink supply member 3 whose strength was found to be as high as 2000 gf or more.

Further, ink was supplied to the container body 2, which was subjected to a long-term storage test (stored for one month at 60° C.) and also to a long-term endurance test of the connection between the ink supply member 3 and the connection member 26 (20,000 times). These tests found no dislocation of the ink supply member 3 from the container body 2 nor any ink leakage.

The liquid container T of this embodiment constructed as described above has the following advantages when compared with a conventional construction in which the container body and the ink supply member are joined with an adhesive.

(1) If the connecting portion of the main tank and the ink supply member 3 of the liquid container T are engaged and disengaged repetitively, the mounting strength of the ink supply member 3 will not deteriorate.

(2) Since there is no adhesive in a jointed portion between the opening 2*a* of the container body 2 and the ink supply member 3, the joint is free from any damage and thus can maintain a high level of airtightness in the container body 2 during the ink supply operation. Thus, the ink in the container body 2 can be prevented from leaking through the joint between the opening 2*a* and the ink supply member 3. This in turn prevents a possible ink leakage from the head cartridge HC which in some case may lead to a more widespread leakage in the entire ink supply system and cause a serious short-circuit trouble in electric circuits.

(3) A quality management system for adhesives and adhesive application and hardening processes are not required, as they are when adhesives are used. This reduces cost and the number of processes.

With the method of manufacturing the liquid container T of this embodiment, it is possible to manufacture with fewer processes and less cost a small liquid container suited for a printing apparatus using the pit-in system. Further, the liquid container manufactured with this method can reliably prevent an ink leakage for a long period of time and ensure high durability and reliability.

Second Embodiment

Next, the second embodiment of this invention will be described by referring to FIGS. 5A and 5B and FIG. 6.

Figure 5A:
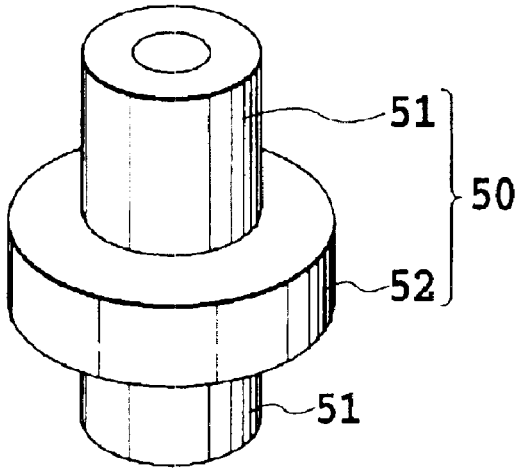
FIG. 5A is a perspective view of an ink supply member according to a second embodiment of the present invention.
Figure 5B:
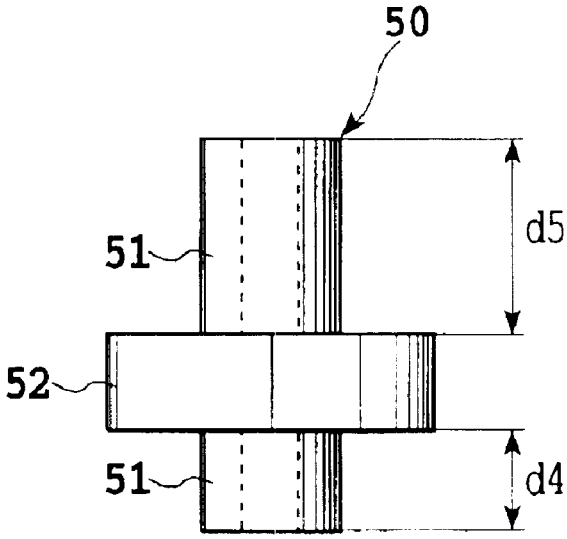
FIG. 5B is a side view of the ink supply member of the second embodiment.

FIGS. 5A and 5B illustrate an outline construction of an ink supply member in the second embodiment, FIG. 5A being a perspective view and FIG. 5B a side view. FIG. 6 shows a method of manufacturing an ink supply member and a container body in the second embodiment. In FIG. 6 those parts identical with the corresponding parts of the first embodiment are assigned like reference numbers and their explanations are omitted.

In the liquid container T of the second embodiment, an ink supply member 50 to be securely fitted in the opening 2*a* formed in the bottom portion of the container body 2 is formed as shown in FIG. 5. In other respects the construction is similar to that of the first embodiment.

The ink supply member 50 of the second embodiment has a cylindrical portion 51 slightly larger in outer diameter than the opening 2*a* and an annular flange portion 52 protruding radially outwardly from a part of an outer circumferential surface of the cylindrical portion 51. The cylindrical portion 51 and the flange portion 52 are formed integral as one piece. The ink supply member 50 is made from a heat resistant material such as stainless steel and ceramics, as in the first embodiment. The flange portion 52 is formed like a ring and has a larger outer diameter than the opening 2*a*. A length of a press fit portion extending from one end face of the flange portion 52 to one end of the cylindrical portion 51, d4, is set larger than a thickness of the bottom portion of the container body 2, L2. A length of another part of the cylindrical portion 51 extending from the other end face of the flange portion 52 to the other end of the cylindrical portion 51, d5, is set longer than the press fit portion length d4.

The ink supply member 50 of the above dimensions and shape is secured to the opening 2*a* of the container body 2 as follows.

First, the ink supply member 50 is held by the holder 33 of FIGS. 3A, 3B and 3C as in the first embodiment and then one end is pressed into the opening 2*a* by the press jig 35.

Since the ink supply member 50 has the flange portion 52 larger in outer diameter than the opening 2*a*, the ink supply member 50 is forcibly inserted into the opening 2*a* until the flange portion 52 engages the bottom portion of the container body 2.

Figure 6:
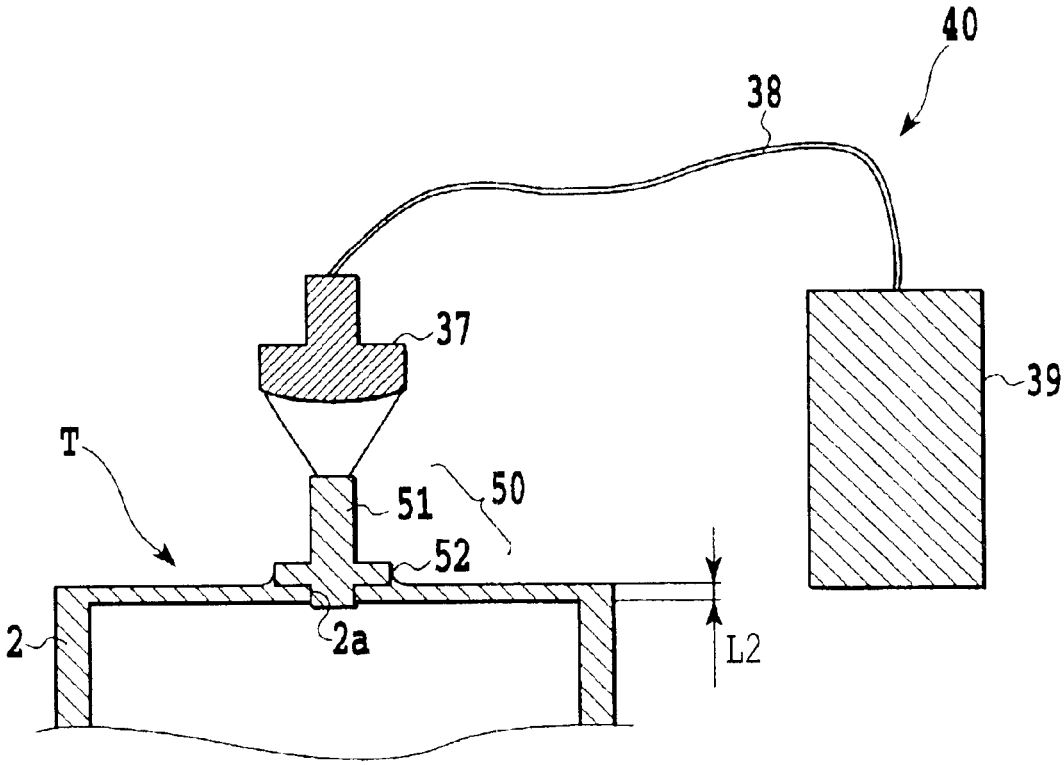
FIG. 6 is an explanatory, vertical side cross-sectional view showing the opening formed in the bottom portion of the container body being indirectly heated after the ink supply member of the second embodiment is fitted under pressure into the opening.

Next, as shown in FIG. 6, a light beam of a particular wavelength emitted from the oscillation source 39 is applied to the ink supply member 50 through the fiber 38 and the fiber lens 37. As a result, a part of the container body 2 starts to be melted by the heat of the ink supply member 50. The melting of the container body 2 occurs not only in the inner circumferential surface of the opening 2*a* (press fit contact surface) in contact with the ink supply member 50 but also in the bottom portion of the container body 2 in contact with the flange portion 52.

After the heating of the ink supply member 50 is finished, the melted portions of the container body 2 harden to form firm joints between the outer circumferential surface of the cylindrical portion 51 of the ink supply member 50 and the inner circumferential surface of the opening 2*a* and between the flange portion 52 of the ink supply member 50 and the bottom surface of the container body 2.

As described above, in the second embodiment, since the container body 2 and the ink supply member 50 are joined without using an adhesive, advantages similar to those of the first embodiment ((1)–(3)) can be obtained. Furthermore, in the second embodiment, not only is the outer circumferential surface of the cylindrical portion 51 of the ink supply member 50 joined with the inner circumferential surface of the opening 2*a*, but the flange portion 52 is also joined with the bottom surface of the container body 2. This results in a wider joint area than in the first embodiment, which in turn assures enhanced joint strength and airtightness, providing a more reliable liquid container T.

While the second embodiment has been described by taking up an example case in which the flange portion 52 of the ink supply member 50 is formed like a ring, the flange portion may also be formed in other geometries, such as polygon. Further, the flange portion may be engaged with an inner surface of the bottom portion of the container body rather than with the outer surface. In this case, it is noted that the ink supply member needs to be inserted from the inside of the container body 2.

Further, although in the first and second embodiment the cylindrical ink supply member slightly larger in outer diameter than the opening is fitted under pressure into the opening formed in the container body, the opening and the ink supply member may be formed in other shapes than circle in cross section.

Further, in FIGS. 3A, 3B and 3C and FIG. 6, the indirect heating means has been described to be used for indirectly heating the portion of the container body surrounding the opening, it is also possible to use direct heating means that directly heats the portion of the container body surrounding the opening.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A method of manufacturing a liquid container for supplying liquid to liquid ejection means, the method comprising:

a press fit step of fitting a cylindrical liquid supply member under pressure into an opening formed in a bottom portion of a container body containing the liquid; and a heating step of heating by predetermined heating means the opening in which the liquid supply member is fitted under pressure by the press fit step;

wherein the opening is heated and melted by the heating step to hermetically secure the opening and the liquid supply member together by thermal fusing;

wherein the heating means is indirect heating means for applying heat to a portion surrounding the opening through the liquid supply member; and wherein the heating means comprises a light beam generator for radiating a beam of light of a predetermined wavelength to the liquid supply member.

* * * * *